US007575726B2

(12) United States Patent
Carroll et al.

(10) Patent No.: US 7,575,726 B2
(45) **Date of Patent: *Aug. 18, 2009**

(54) SNAP-FIT CATALYST DEVICE

(75) Inventors: Joseph Allen Carroll, Lilburn, GA (US); Robert L. Mitchell, Atlanta, GA (US)

(73) Assignee: Applied Technology Limited Partnership, Doraville, GA (US)

( * ) Notice: Subject to any disclaimer, the term of this patent is extended or adjusted under 35 U.S.C. 154(b) by 131 days.

This patent is subject to a terminal disclaimer.

(21) Appl. No.: 11/552,762

(22) Filed: Oct. 25, 2006

(65) Prior Publication Data

US 2007/0048197 A1 Mar. 1, 2007

Related U.S. Application Data

(63) Continuation-in-part of application No. 09/827,473, filed on Apr. 6, 2001, now Pat. No. 7,138,092.

(51) Int. Cl.
*B01D 50/00* (2006.01)
*F23J 11/00* (2006.01)

(52) U.S. Cl. ..... 422/177; 422/180; 126/312

(58) Field of Classification Search ..... 422/180, 422/177; 126/299 R, 312, 307, 203, 289, 126/285 R, 77, 123

See application file for complete search history.

(56) References Cited

U.S. PATENT DOCUMENTS

| | | | |
|---|---|---|---|
| 3,536,457 | A | 10/1970 | Hendreson |
| 3,785,778 | A | 1/1974 | Burstein et al. |
| 4,437,451 | A | 3/1984 | Wysong |
| 5,285,640 | A | 2/1994 | Olivo |
| 5,934,268 | A | 8/1999 | Onocki |

FOREIGN PATENT DOCUMENTS

| | | | |
|---|---|---|---|
| DE | 199 12 453 | A | 9/2000 |
| DE | 19912453 | A1 * | 9/2000 |
| EP | 0 831 277 | A1 | 3/1998 |
| FR | 2 739 791 | A | 4/1997 |
| GB | 1 204 423 | | 9/1970 |
| JP | 55096820 | | 7/1980 |
| JP | 62237930 | | 10/1987 |

OTHER PUBLICATIONS

Disclosure Under 37 CFR § 1.56 dated Jan. 12, 2009, filed for U.S. Appl. No. 11/552,762.
Vent Tube Adaptor Mechanical Drawings, Frigidare Canada.

* cited by examiner

*Primary Examiner*—Tom Duong
(74) *Attorney, Agent, or Firm*—Sutherland Asbill & Brennan LLP

(57) ABSTRACT

A catalytic converter device, useful with a self-cleaning oven, is provided. The device includes (a) a dish-shaped body formed of a mesh of metal strands, the body having a base member, sidewalls projecting from the base member, and a flange extending out from the sidewalls, the mesh having a plurality of apertures therethrough; (b) a catalytic material on at least the surface of the mesh; and (c) one or more locking tabs extending from the sidewalls, wherein the locking tabs and flange cooperate to secure the device within an orifice of a gas vent so exhaust gases will pass through the apertures. The locking tabs can be formed by punching a hole in the sidewall, such that each locking tab remains integral with the sidewall, the locking tab projecting from an edge of the hole distal the flange and at angle toward the flange.

20 Claims, 7 Drawing Sheets

SNAP-FIT CATALYST DEVICE

CROSS-REFERENCE TO RELATED APPLICATIONS

This is a continuation-in-part of U.S. application Ser. No. 09/827,473, filed Apr. 6, 2001, now pending. That application is incorporated herein by reference.

BACKGROUND OF THE INVENTION

The devices and methods described herein are generally in the field of catalytic converter-type smoke eliminators, such as found in self-cleaning ovens.

Self-cleaning ovens clean by heating the oven above normal cooking temperatures to burn off and eliminate the residues created in the oven during normal cooking. The organic cooking residues oxidize and evolve as smoke and vapors, which comprise volatile organic compounds (VOCs) and particulate matter. Standard commercially available ovens include catalytic converters. These catalytic converters complete the oxidation process, converting the evolved smoke and vapors into carbon dioxide and water, thereby preventing smoke and odors from escaping into the kitchen during the self-cleaning cycle.

Standard catalytic converters for self-cleaning ovens normally include a catalyst coated ceramic honeycomb-shaped disk. These coated ceramic disks are positioned within the oven's exhaust conduit or vent, through which the hot smoke and VOCs pass. The disks, typically 1¼" to 2" in diameter and ½" thick, are mounted in a flanged, cylindrical metal tube (or can), roughly 1" to 5" long, with impingement-crimped restraints on both sides of the disk. A metal sealing ring optionally is provided around the top circumference of the ceramic disk, forming a seal between the interior wall surface of the metal tube and the outer circumferential surface of the ceramic disk, to reduce gas bypass. The sealing ring also protects the ceramic disk from fracture during the crimping process, as the ring is interposed between the top surface of the ceramic disk and the notches of the impingement-crimped restraints. The flanged tube, which serves as at least a portion of the exhaust vent, is then mounted with screws into the kitchen range in communication with the self-cleaning oven. Another design of catalytic converter includes catalyst coated metal screens mounted in a metal tube, much like the ceramic substrate is.

A continuing trend in kitchen range design includes exhaust vents that have sharp bends and/or flat shapes, in which the standard cylindrical can and/or the ½ inch thick disk will not fit. In addition, catalyst installation with a separate metal can is labor-intensive and uneconomical. It would be advantageous to simplify the installation of a ceramic substrate catalyst or a catalyst coated metal screens into an exhaust vent that is narrow, flat, or has sharp bends, without the need for separate mounting components, such as screws. It therefore would be desirable to provide such catalyst devices that can be directly and easily installed into exhaust vents of any of a variety of self-cleaning oven applications.

SUMMARY OF THE INVENTION

Catalytic converter devices and exhaust vent installation systems are provided for use with an oven, particularly the self-cleaning ovens of kitchen ranges, and other devices or systems in which catalytic conversion of a flue gas is desirable.

In one aspect, a catalytic converter device is provided that includes: (a) a dish-shaped body formed of a mesh of metal strands, the body having a base member, sidewalls projecting from the base member, and a flange extending out from the sidewalls at a position distal from the base member, the mesh having a plurality of apertures therethrough; (b) a catalytic material on at least the surface of the mesh of metal strands; and (c) one or more (e.g., two, three, four, five, or six) locking tabs extending from the sidewall, the one or more locking tabs and the flange cooperating to secure the device within an orifice of the gas vent such that gases flowing into the vent will pass through the apertures. The base member can be in the shape of a round disk, which for example can have a diameter between about ½ inch and about 2 inches. The sidewall can have a height, for example, of between about 1/32 inch and about ½ inch or more.

The catalytic material may comprise a noble or precious metal, such as platinum, palladium, rhodium, ruthenium, iridium, osmium, silver, gold and mixtures thereof. The catalytic material may comprise a base metal, such as zinc, nickel, copper, manganese, iron, chromium, vanadium, molybdenum, and mixtures thereof.

In one embodiment, each locking tab is formed by punching a hole in the sidewall, such that a portion of each locking tab remains integral with the sidewall. In a preferred variation, the locking tab projects from an edge of the hole distal the flange and at an angle toward the flange.

In one embodiment, the mesh comprises woven metal strands. In an alternative embodiment, a collection of non-woven strands is bonded together, for example, by sintering them. In one embodiment, the mesh of metal strands is coated with the catalyst material. In another embodiment, the mesh of metal strands is formed of (e.g., consists essentially of) the catalyst material.

In another aspect, an oven is provided which comprises one of the foregoing catalytic converter devices. In one embodiment, the oven is a self-cleaning kitchen oven.

In still another embodiment, a method is provided for reducing smoke and volatile organic compounds present in a gas flowing into a vent, which could be part of a kitchen range which comprises a self-cleaning oven. In one embodiment, the method comprises flowing the gas through apertures in a mesh of metal strands in a dish-shaped body of a catalytic converter device, at least the surface of the mesh of metal strands comprising a catalyst material, to oxidize smoke and volatile organic compounds present in the gas, wherein the body is secured within an orifice in the gas vent by the cooperation of one or more locking tabs and a flange which extend from sidewalls of the body.

In yet another aspect, an exhaust vent is provided for venting gases from an oven. In one embodiment, the exhaust vent comprises (a) a tube having an inlet orifice and an outlet orifice and having a gas passageway therebetween, the inlet orifice being defined in a planar body having an inner surface and an outer surface; and (b) a catalytic converter device secured within the inlet orifice, the device comprising (i) a dish-shaped body formed of a mesh of metal strands, the body having a base member, sidewalls projecting from the base member, and a flange extending out from the sidewalls at a position distal from the base member, the mesh having a plurality of apertures therethrough; (ii) a catalytic material on at least the surface of the mesh of metal strands; and (iii) one or more locking tabs extending from the sidewalls, wherein the locking tabs engage either the inner surface or the outer surface of the planer body of the vent, and the flange engages other of the inner surface or outer surface, the locking tabs and the flange cooperating to secure the device within the inlet orifice such that gases flowing into the vent will pass through the apertures.

The catalytic converter devices can be used in a variety of residential, commercial, or industrial ovens, as well as other devices or systems in which catalytic conversion of a flue gas is desirable. Self-cleaning kitchen ovens are preferred. The devices are used to reduce smoke and volatile organic compounds present in an exhaust gas flowing from an oven, such as in an exhaust gas vent.

BRIEF DESCRIPTION OF THE DRAWINGS

FIG. 4A is a top view and FIG. 4B is a cross-sectional view.

FIG. 7D shows a close-up view of one embodiment of a locking tab punched out of the sidewall of the mesh substrate body.

DETAILED DESCRIPTION OF THE INVENTION

Improved catalytic converter devices and exhaust vents have been developed for easier and more economical assembly and installation into a self-cleaning kitchen range or other self-cleaning oven. The present devices save space, installation time, and cost over commercially available catalytic converters.

The Catalytic Converter Device

The catalytic converter device includes a substrate, a catalyst material on the surface of the substrate (e.g., as a coating), and a means for securing the substrate into an orifice of a gas vent (e.g., an oven vent), such that exhaust gases flowing through the vent will pass through apertures in the device to oxidize smoke and volatile organic compounds present in the gas. The substrate can be in the form of a mesh of metal strands or it can in the form of a ceramic body. The means for securing the metal mesh substrate/catalyst can be an integral feature built into the substrate, or it can be a mounting ring. The means for securing the ceramic substrate generally includes a mounting ring.

Metal Mesh Device

Figure 7A:
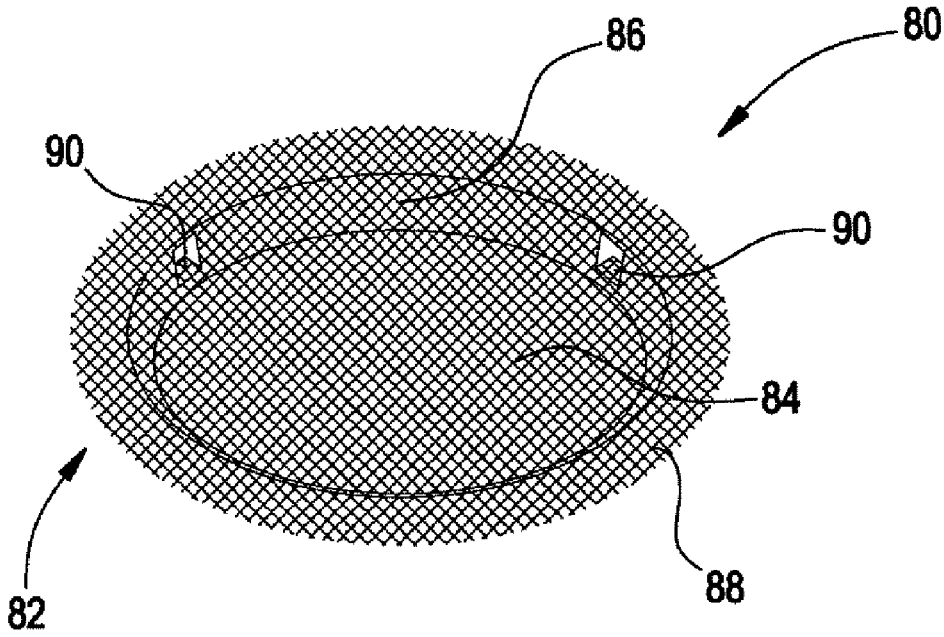
FIGS. 7A-D show one embodiment of the snap-fit, metal mesh catalyst device with integral locking tabs, in a perspective view (FIG. 7A), in a plan view (FIG. 7B), and in a elevational view (FIG. 7C).
Figure 7B:
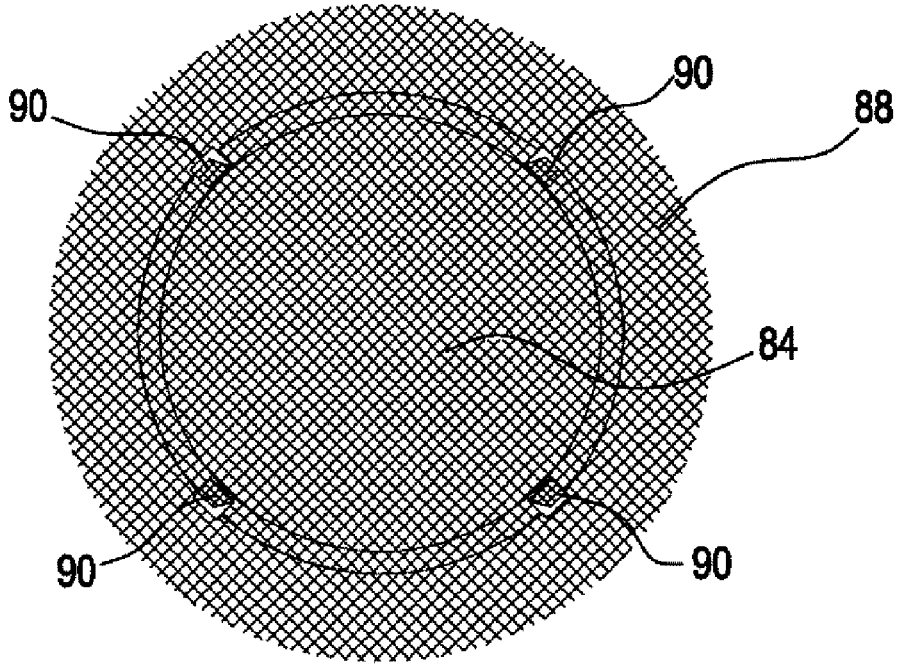
Figure 7C:
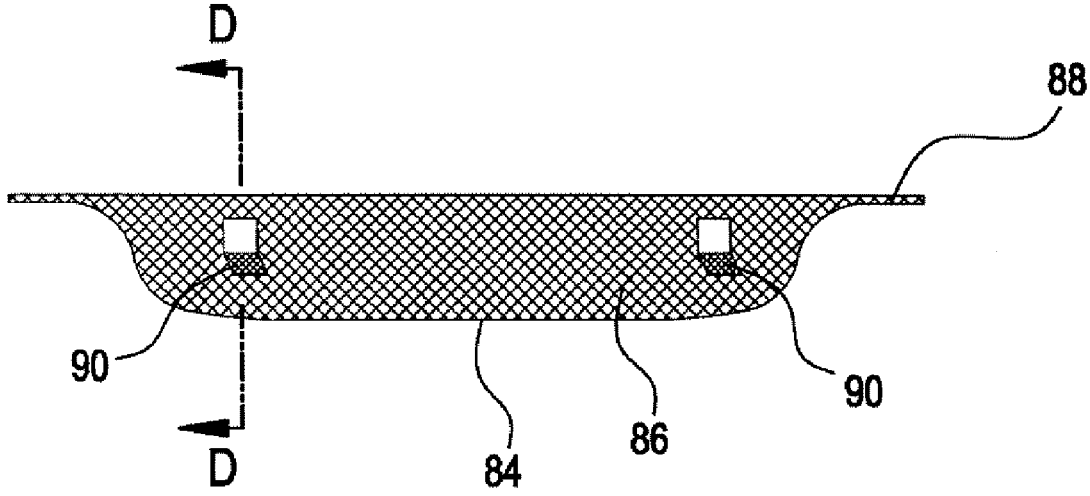
Figure 7D:
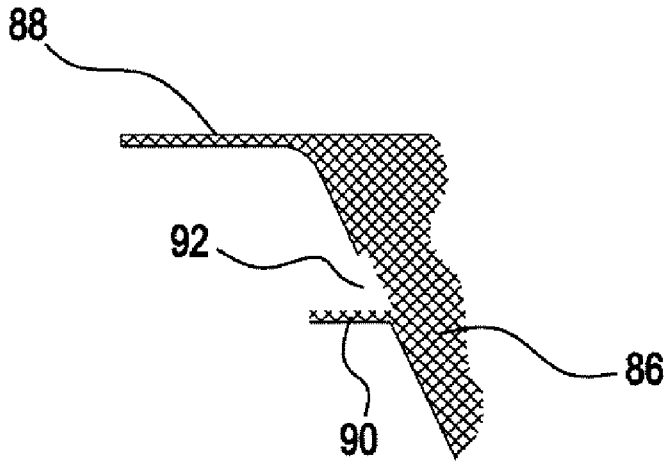

One non-limiting example of a catalytic converter device which utilizes the mesh of metal strands is illustrated in FIGS. 7A-7D. The device 80 includes a dish-shaped body 82 formed of a mesh of metal strands, wherein the body 82 has a base member 84, sidewalls 86 projecting from the base member 84, and a flange 88 extending out from the sidewall 86 at a position distal from the base member 84. The flange can be substantially parallel to the base member. Two or more (e.g., three, four, five, six, or more) locking tabs 90 extend from and are spaced about the outer surface of the sidewalls 86. In one embodiment, each locking tab is formed by punching a hole in the sidewall, such that a portion of each locking tab remains integral with, i.e. connected to, the sidewall. In one specific example, which is illustrated in FIG. 7D, the locking tab 90 projects from an edge of the hole 92 in the sidewall 86 distal the flange 88 and at angle slightly toward the flange 88. The installation process may include bending the locking tabs slightly up to secure the catalyst device into the orifice. The locking tabs 90 and the flange 88 cooperate to secure the device within an orifice of a gas vent such that gases flowing into the vent will pass through the apertures.

Figure 8:
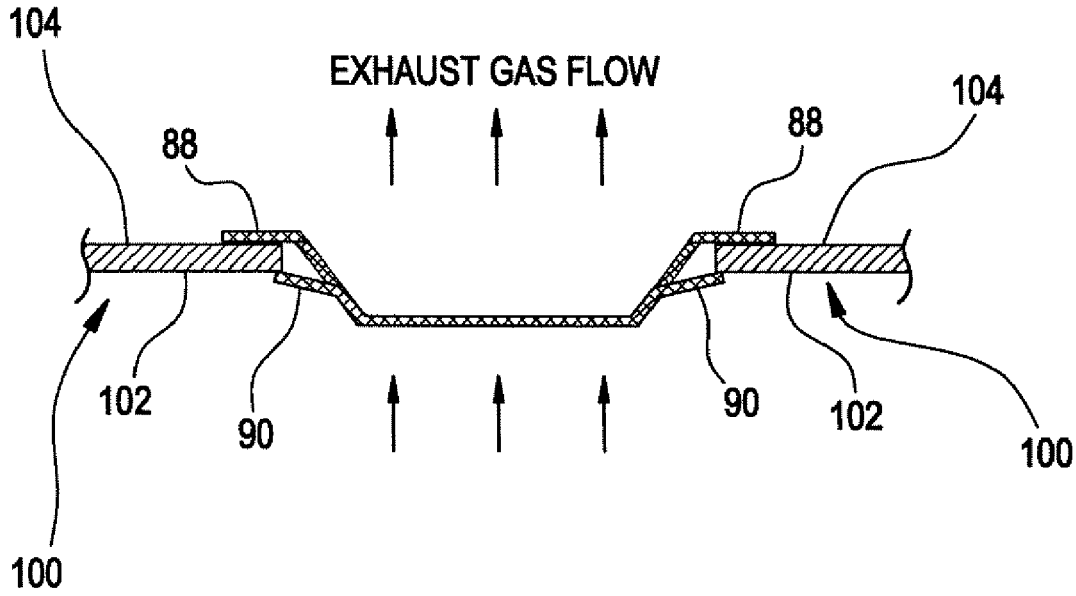
FIG. 8 is a cross-sectional view of one embodiment of the snap-fit, metal mesh catalyst device secured within an orifice in portion of an exhaust vent.

In one embodiment, an exhaust vent is provided which comprises a tube having an inlet orifice and an outlet orifice and having a gas passageway therebetween. The inlet orifice is defined in a planar body portion of the exhaust vent, wherein the body portion has an inner surface and an outer surface. FIG. 8 shows one embodiment of the catalytic converter device secured in such an orifice, where locking tabs 90 are engaged with the outer surface 102 of the planer body 100 of the exhaust vent, and flange 88 is supported against the inner surface 104 of the planar body 100; the locking tabs and the flange cooperate to secure the device within the inlet orifice such that gases flowing into the vent will pass through the apertures.

The size of the substrate can vary to accommodate a variety of oven sizes and gas flow rates, as well as operational and manufacturing considerations. The base member can be in the shape of a round disk, which may have a diameter, for example, between about ½ inch and about 2 inches. The sidewall may have a height, for example, of between about 1/32 inch and about ½ inch.

The metal mesh substrate generally is formed from a sheet of woven or non-woven metal strands, and it has regularly or irregularly sized and spaced apertures therethrough. The woven mesh is sometimes referred to in the art as a screen, given its visual similarity to a window screen. The metal strands can be formed from or coated with the catalyst material. In one embodiment, the mesh comprises woven metal strands. In an alternative embodiment, a collection of non-woven strands are bonded together, for example, by sintering them. In one embodiment, the mesh of metal strands is coated with the catalyst material. In another embodiment, the mesh of metal strands is formed of (e.g., consists essentially of) the catalyst material.

Ceramic Substrate

The ceramic substrate has a first surface, a second surface, a circumferential surface, and a plurality of apertures extending through the substrate from the first surface to the second surface. The first surface and second surface preferably are substantially flat or planar, and preferably are substantially parallel to one another. The circumferential surface preferably is circular, although essentially any other shape, such as square, oval, or triangular, can be used. The apertures preferably are circular or square, but can be other shapes as well. The apertures can extend through the substrate along axes that are perpendicular or angled with respect to the first surface, the second surface, or both surfaces. In a preferred embodiment, the apertures are patterned across the substrate in a honeycomb-like array. The particular dimensions can be readily selected based upon the specific design parameters of the vent, oven, or other device in which the catalytic converter device is to be installed and used.

In a preferred embodiment for use with self-cleaning kitchen ovens, the ceramic substrate is in the shape of a round disk. The disk may have a thickness of between about 1/32" and about 1/2", such as between about 1/8" and about 1/4", and may have a diameter of between about 1/2" and about 2", such as between about 1" and about 1 5/8". However, depending on design factors, such as the requirements of the oven manufacturer, other shapes and sizes of the ceramic substrate may be desired.

The ceramic material forming the ceramic substrate can be selected from a variety of ceramic materials known in the art. Representative examples of ceramic materials suitable for use as the ceramic substrate include cordierite, mullite, alumina, and silica. Cordierite often is a preferred substrate material, primarily for its low thermal expansion characteristics. A catalyst material coating typically is in a discontinuous form on the ceramic substrate.

The ceramic substrate can be made using ceramic molding, cutting, and firing techniques known in the art. See, for example, U.S. Pat. No. 3,790,654 to Bagley and U.S. Pat. No. 3,801,289 to Wiley.

The Catalyst Material

The substrate—e.g., ceramic, metal screen, etc.—has a surface that includes a catalyst. Suitable catalyst materials are selected from precious metals, base metals, or a combination thereof. Non-limiting examples of precious metals include palladium, platinum, rhodium, ruthenium, iridium, osmium, silver, and gold. The precious metal may also be a reduced precious metal, precious metal oxide, precious metal sulfide, precious metal with modifiers, or a combination thereof. Non-limiting examples of modifiers include potassium, calcium, magnesium, sodium hydrated oxides, and sodium hydroxides. Non-limiting examples of base metal include zinc, nickel, copper, manganese, iron, chromium, vanadium, molybdenum, and combinations thereof.

For coated substrates, the coating is applied using techniques known in the art to coat substantially all surfaces of the ceramic or metal substrate to maximize the area of contact between the catalyst and the gases flowing over and through the substrate. A substrate also preferably includes a high surface area wash coat, preferably a gamma alumina wash coat, applied before or with the catalyst coating, which serves to substantially increase the surface area of the substrate. Such wash coating processes are known in the art. Catalyst coatings may be applied, for example, by dip coating, by spray coating, or by chemical vapor deposition methods in the art.

The appropriate catalyst can be selected for each oven application. For self-cleaning kitchen ovens, the catalyst preferably should substantially effect complete oxidation of VOCs at about 600° F.

Mounting Ring

The optional mounting ring protects the ceramic substrate during installation and maintenance of the catalytic converter, and advantageously provides quick and easy installation of the device into an oven. In one embodiment, the mounting ring includes (i) a body in the shape of a ring; (ii) one or more retaining tabs extending from the body which secure the ceramic substrate within the ring about the circumferential surface of the ceramic substrate; and (iii) one or more locking tabs extending from the body. The one or more locking tabs are adapted to engage one or more surfaces of an exhaust vent of the oven to secure the catalytic converter within an orifice of the exhaust vent. Preferably the locking tabs secure the mounting ring by clipping, e.g., by snap-fit or slide-lock engagement, within the orifice, such that no screws are required and assembly is simplified.

By "shape of a ring" is meant that the body surrounds or forms a ring around the perimeter or circumferential surface of the ceramic substrate, whatever shape the circumference may be. Thus, while the ring shape preferably is circular, it can be elliptical, square, rectangular, or essentially any other shape in which the substrate periphery may be made.

In one embodiment, the mounting ring further includes a first lip extending inwardly from a first edge of the body. The first lip works in conjunction with the retaining tabs to secure the ceramic substrate within the ring. That is the substrate is trapped between the retaining tabs, which are bent in a position over an edge portion of the first surface of the ceramic substrate at a second edge of the body, and the first lip, which is positioned over an edge portion of the second surface of the ceramic substrate.

In another embodiment, the mounting ring further comprises a second lip extending outwardly from the second edge of the body. The second lip and locking tabs preferably are used to secure the mounting ring (and thus the catalytic converter device) within the orifice of the exhaust vent. This securing preferably is accomplished by snapping the mounting ring into the orifice such that a portion of one or more surfaces of the exhaust vent, such as those surfaces adjacent the orifice, are locked into place between the second lip and the locking tabs. In other words, the edge of the vent surrounding the orifice is captured between the second lip and the locking tabs.

In preferred embodiments, the mounting ring comprises two, three, or more preferably four, retaining tabs, and two, three, or more preferably four locking tabs. In another preferred embodiment, the locking tabs extend from the retaining tabs. The retaining tabs should be spaced about the ring. For example, four folding tabs preferably are spaced 90° from one another on a circular ring-shaped body.

In a preferred embodiment, the body is in the shape of a circular ring having an internal diameter of between about 1" and 1 5/8".

In yet another embodiment, retaining tabs are bent over both the first surface and the second surface of the ceramic substrate, and the mounting ring is integrally formed into the exhaust vent, eliminating the need for locking tabs.

The mounting ring preferably is formed from a metal, although other non-metal, heat resistant materials can be used. Such materials should be substantially rigid and durable. Preferred metal materials include steels, stainless steels, aluminum, aluminized steels, and mixture or combinations thereof.

Figure 1A:
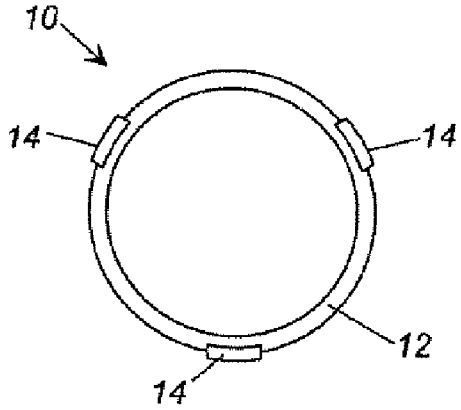
FIGS. 1A and 1B are top and bottom views, respectively, illustrating a preferred embodiment of the mounting ring of the catalytic converter device.
Figure 1B:
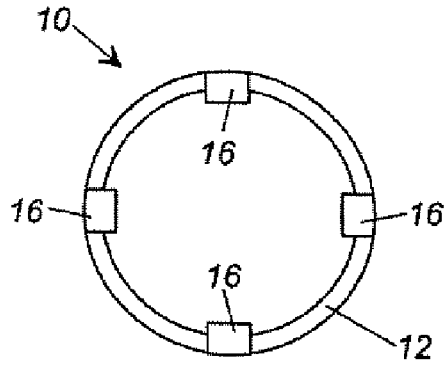
Figure 2:
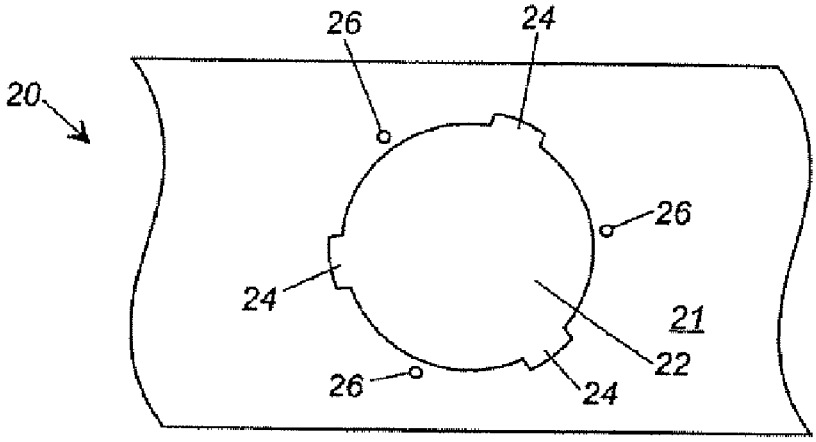
FIG. 2 is a top view of a portion of a flat tube exhaust vent having an orifice into which a preferred embodiment of the catalytic converter device can be installed.
Figure 3:
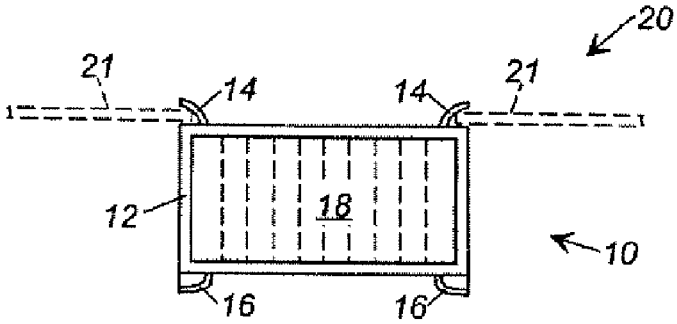
FIG. 3 is a cross-sectional view showing the mounting ring of FIGS. 1A and 1B installed, with a catalyst-coated ceramic substrate, in the orifice of the flat tube exhaust vent of FIG. 2.

The mounting ring embodiment of the catalytic converter device can be farther understood with reference to the non-limiting examples illustrated in FIGS. 1-5. FIGS. 1A and 1B show top and bottom views, respectively, of mounting ring 10 having body 12, locking tabs 14, and retaining tabs 16. FIG. 2 illustrates a portion of a flat tube exhaust vent 20 having orifice 22 in vent wall 21. The orifice 22 includes cutouts 24 corresponding to the locking tabs 14. The vent wall 21 includes a plurality of dimples 26 between the cutouts 24 to enhance the locking function. FIG. 3 illustrates mounting ring 10 installed in orifice 22 of flat tube exhaust vent 20 and held in place with locking tabs 14. The mounting ring is shown with catalyst coated ceramic substrate 18 contained within body 12, secured by retaining tabs 16.

Figure 4A:
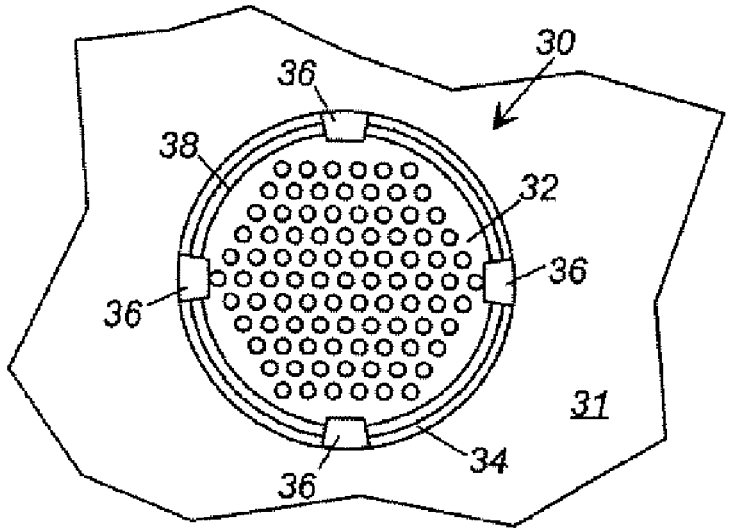
FIGS. 4A and 4B show a preferred embodiment of the catalytic converter device installed position in an orifice of a exhaust vent wall.
Figure 4B:
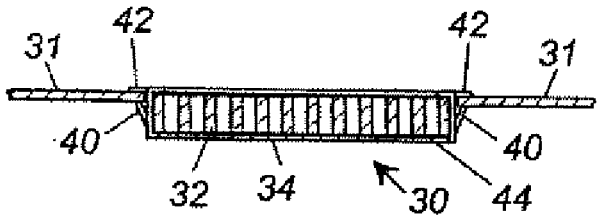
Figure 4C:
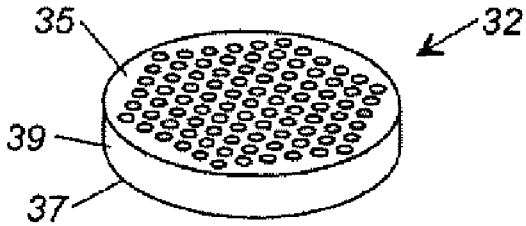
FIG. 4C is a perspective view of a preferred embodiment of the ceramic substrate, isolated from the catalytic converter device of FIG. 4A.
Figure 4D:
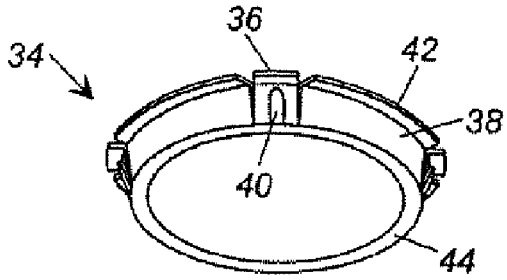
FIG. 4D is partial, perspective view of a preferred embodiment of the mounting ring, wherein the first lip is shown in its entirety while the remainder of the mounting ring is shown in part.

FIGS. 4A and 4B show another embodiment of the catalytic converter device in an installed position. Catalytic converter device 30 is secured within vent wall 31, and includes catalyst coated ceramic substrate 32 in mounting ring 34. The mounting ring 34 includes retaining tabs 36 and first lip 44 extending from body 38. Also extending from the body 38 are locking tabs 40 and second lip 42, between which the edge of vent wall 31 is secured. FIG. 4C illustrates ceramic substrate 32 in isolation, showing first surface 35, second surface 37, and circumferential surface 39. FIG. 4D illustrates a portion of mounting ring 34, more clearly showing body 38, first lip 44, second lip 42, retaining tab 36, and locking tab 40. Locking tab 40 extends outwardly from retaining tab 36.

Figure 5A:
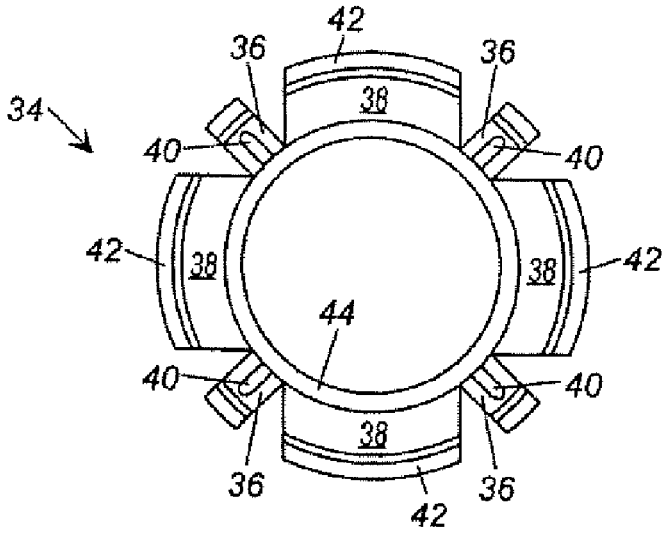
FIG. 5A is a top view of a metal preform of a preferred embodiment of the mounting ring.
Figure 5B:
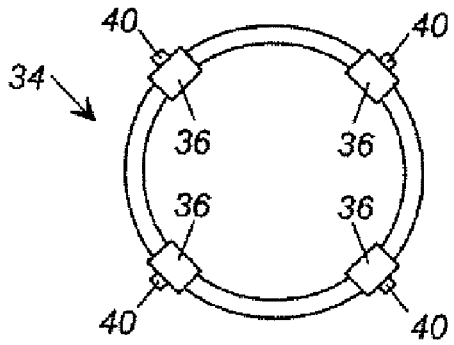
FIG. 5B is a top view of the mounting ring formed after the preform of FIG. 5A is bent into the appropriate shape.

The mounting ring is stamped from a sheet of metal, preferably about 0.021 inches thick, to yield a cutout preform, as shown in FIG. 5A. The preform is then bent into the required shape, as shown in FIG. 5B. In FIGS. 5A and 5B, mounting ring 34 includes body 38, first lip 44, second lip 42, retaining tabs 36, and locking tabs 40. Alternatively, the mounting ring may be fabricated using molding and other fabrication techniques known in the art. The retaining tabs and locking tabs can be integral with the body or fabricated separately and then attached to the body, although the former typically is preferred. Securing the catalyst-coated ceramic substrate into the mounting ring is simple.

Preferably, the ring-shaped body first is readied to receive the substrate, either by being provided with a first lip or by bending one or more retaining tabs along the first edge, while the retaining tabs for the upper side are in their unbent position. Next, the substrate is placed within the ring via the open second edge. Then, the retaining tabs are bent over the first surface of the substrate along the second edge of the body, thereby trapping the substrate in the ring. The mounting ring then is clipped into place in a vent, such as at an inlet orifice of an oven exhaust vent. In one embodiment, the mounting ring is pushed straight into an orifice in a flat tube shape exhaust vent, wherein the orifice has a diameter slightly larger than that of the body of the mounting ring. Once inserted, the mounting ring is rotated, typically between 10 and 45°, to secure the mounting ring in place. See FIGS. 1-3 described above.

Use of the Catalytic Converter Devices

The catalytic converter device is used in substantially the same manner as current commercially available catalytic converters. The catalytic converter devices can be adapted to remove smoke and VOCs from small quantities of air or other gases from a variety of sources. The converted air can be released wherever appropriate, but the catalytic converter devices are particularly useful where the air is returned indoors instead of being vented outdoors.

In a preferred embodiment, the catalytic converter device is employed in a self-cleaning kitchen oven. The catalytic converter device must be mounted in sufficient thermal proximity to the heat source of the oven so that the catalyst can reach its light-off temperature, that is, the temperature required to trigger the catalytic oxidation reaction. The oven is operated in the self-cleaning mode as directed by the oven manufacturer, which typically involves heating the oven above normal cooking temperatures to partially burn and volatilize the organic cooking residues. Convective forces cause the resulting smoke and vapors comprising VOCs and particulate matter to pass into an exhaust vent and contact the catalyst of the catalytic converter device. The catalytic converter complete the oxidation process, converting the evolved smoke and vapors into carbon dioxide and water, which then flow from the exhaust vent. Thus, smoke, VOCs, and unpleasant odors are prevented from escaping the oven and into the kitchen.

Figure 6A:
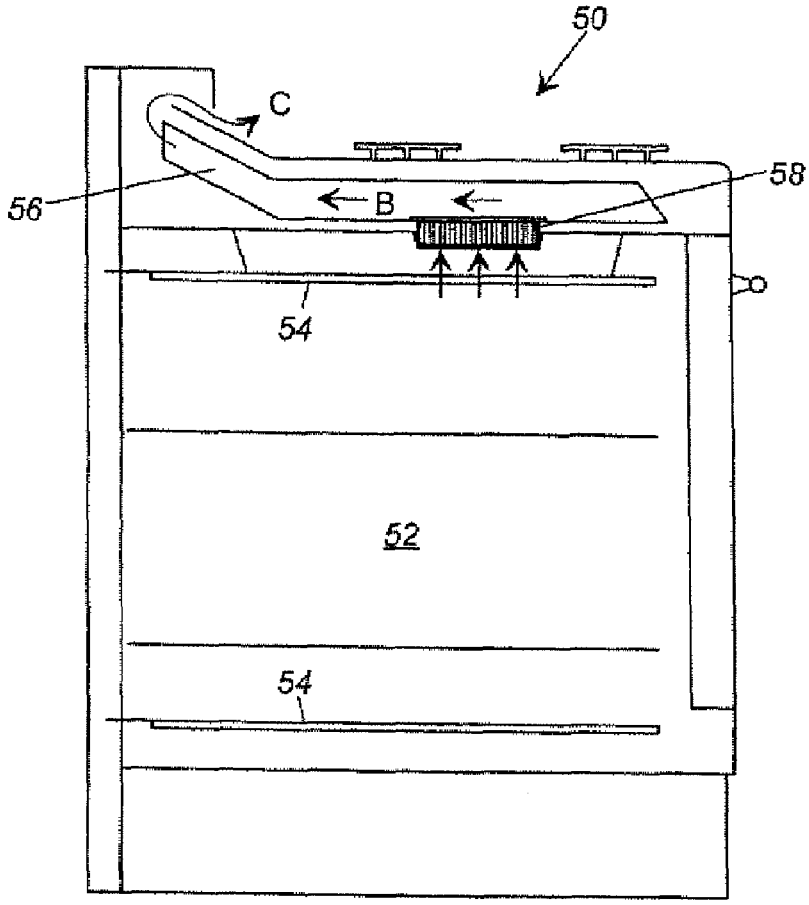
FIG. 6A is a cross-sectional view of one embodiment of a self-cleaning kitchen oven having an exhaust vent including a preferred embodiment of the catalytic converter device.
Figure 6B:
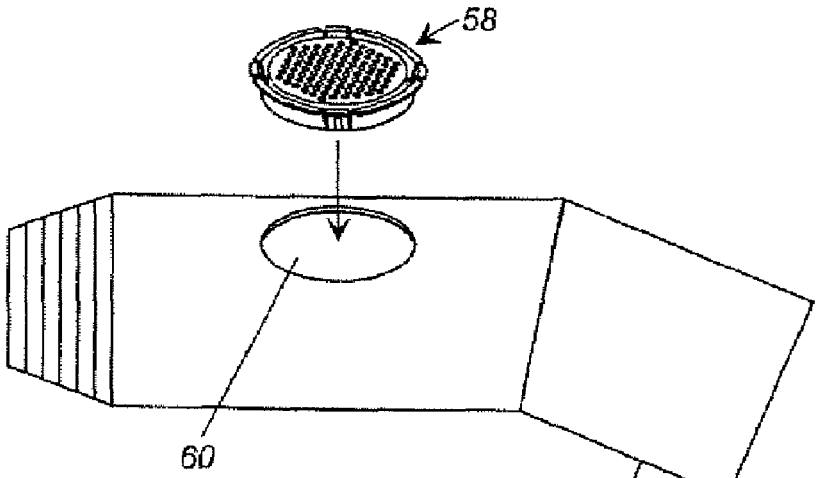
FIG. 6B is a bottom, perspective view of the exhaust vent and catalytic converter device.

A non-limiting example of a self-cleaning kitchen oven using the catalytic converter device described herein is shown in FIGS. 6A-6B. FIG. 6A shows a kitchen range 50 including oven 52, electric heating elements 54, exhaust vent 56, and catalytic converter device 58. Arrows A, B, and C illustrate the exhaust gas flow path from the oven, through the apertures of the catalytic converter device 58, through the exhaust vent 56, and finally out of the kitchen range 50. FIG. 6B illustrates the bottom of surface of the exhaust vent 56, and shows the orifice 60 in which the catalytic converter device 58 is clipped.

The catalytic converter device may also be used in other types of ovens, such as commercial and laboratory ovens. For example, the catalytic converter device can he used with the dental mold ovens used to thermally remove wax from various dental prosthetics made by wax molds. The process of burning off the wax results in VOCs being evolved. These VOCs can be oxidized and eliminated using the present catalytic converter device, preventing their release into dentists' laboratories and offices.

Those skilled in the art will recognize, or be able to ascertain using no more than routine experimentation, many equivalents to the specific embodiments of the invention described herein.

We claim:

1. A catalytic converter device for use in a gas vent comprising:

a dish-shaped body formed of a mesh of metal strands, the body having a base member, sidewalls projecting from the base member, and a flange extending out from the sidewalls at a position distal from the base member such that the base member, the sidewalls, and the flange are integrally formed of the mesh, the mesh having a plurality of apertures therethrough;

a catalytic material on at least the surface of the mesh of metal strands; and one or more locking tabs extending from the sidewall, the one or more locking tabs and the flange being adapted to cooperatively secure the device within an orifice of the gas vent such that gases flowing into the vent will pass through the apertures.

2. The catalytic converter device of claim 1, wherein the base member is in the shape of a round disk.

3. The catalytic converter device of claim 2, wherein the base member has a diameter of between about ½ inch and about 2 inches.

4. The catalytic converter device of claim 1, which comprises two, three, four, five, or six locking tabs.

5. The catalytic converter device of claim 1, wherein each locking tab is formed by punching a hole in the sidewall, such that each locking tab remains integral with the sidewall.

6. The catalytic converter device of claim 5, wherein the locking tab projects from an edge of the hole distal the flange and at angle toward the flange.

7. The catalytic converter device of claim 1, wherein the mesh comprises woven metal strands.

8. The catalytic converter device of claim 1, wherein the mesh of metal strands is coated with the catalyst material.

9. The catalytic converter device of claim 1, wherein the mesh of metal strands is formed of the catalyst material.

10. The catalytic converter device of claim 1, wherein the sidewall has a height of between about 1/32 inch and about 1/2 inch.

11. The catalytic converter device of claim 1, wherein the catalytic material comprises a noble or precious metal selected from the group consisting of platinum, palladium, rhodium, ruthenium, iridium, osmium, silver, gold, and mixtures thereof.

12. The catalytic converter device of claim 1, wherein the catalytic material comprises a base metal selected from the group consisting of zinc, nickel, copper, manganese, iron, chromium, vanadium, molybdenum, and mixtures thereof.

13. An oven comprising the catalytic converter device of claim 1.

14. The oven of claim 13, which is a self-cleaning kitchen oven.

15. An exhaust vent for venting gases from an oven, comprising:

a tube having an inlet orifice and an outlet orifice and having a gas passageway therebetween, the inlet orifice being defined in a planar body having an inner surface and an outer surface; and a catalytic converter device secured within the inlet orifice, the device comprising (i) a dish-shaped body formed of a mesh of metal strands, the body having a base member, sidewalls projecting from the base member, and a flange extending out from the sidewalls at a position distal from the base member, the mesh having a plurality of apertures therethrough; (ii) a catalytic material on at least the surface of the mesh of metal strands; and (iii) one or more locking tabs extending from the sidewalls, wherein the locking tabs engage either the inner surface or the outer surface of the planar body of the vent, and the flange engages other of the inner surface or outer surface, the locking tabs and the flange cooperating to secure the device within the inlet orifice such that gases flowing into the vent will pass through the apertures.

16. The exhaust vent of claim 15, wherein the catalytic material comprises a noble or precious metal selected from the group consisting of platinum, palladium, rhodium, ruthenium, iridium, osmium, silver, gold, and mixtures thereof.

17. The exhaust vent of claim 15, wherein the catalytic material comprises a base metal selected from the group consisting of zinc, nickel, copper, manganese, iron, chromium, vanadium, molybdenum, and mixtures thereof.

18. A catalytic converter device comprising:

a ceramic substrate having a first surface, a second surface, a circumferential surface, and a plurality of apertures extending through the substrate from the first surface to the second surface;

a material coating the ceramic substrate, wherein the coating material comprises a catalyst; and a mounting ring comprising (i) a body in the shape of a ring, the body having an upper edge portion and a distal lower edge portion;

(ii) one or more retaining tabs extending inwardly from the upper edge portion and at least one first lip extending inwardly from the lower edge portion, the one or more retaining tabs and the at least one first lip cooperating to secure the ceramic substrate therebetween within the ring about the circumferential surface of the ceramic substrate; and (iii) one or more locking tabs extending outwardly from the body and at least one second lip extending outwardly from the body, wherein an edge of an orifice in an oven vent can be locked into place between the one or more locking tabs and the at least one second lip by slide-lock engagement such that gases flowing through the oven vent will pass through the apertures of the substrate.

19. The catalytic converter of claim 18, wherein the mounting ring comprises three locking tabs.

20. The catalytic converter of claim 18, wherein the one or more locking tabs are adapted to correspond to cut-outs on the edge of the orifice in the oven vent.

* * * * *